US007904988B2

(12) United States Patent
Stein et al.

(10) Patent No.: US 7,904,988 B2
(45) Date of Patent: Mar. 15, 2011

(54) SELF-SUPPORTING MANUAL TOOTHBRUSH

(75) Inventors: Volker Stein, Aurora (CA); Robert G. Dickie, Newmarket (CA)

(73) Assignee: Vorsten Enterprises Ltd., Aurora, Ontario (CA)

( * ) Notice: Subject to any disclaimer, the term of this patent is extended or adjusted under 35 U.S.C. 154(b) by 489 days.

(21) Appl. No.: 12/025,378

(22) Filed: Feb. 4, 2008

(65) Prior Publication Data

US 2009/0193599 A1 Aug. 6, 2009

(51) Int. Cl.
*A46B 5/00* (2006.01)
*A46B 15/00* (2006.01)

(52) U.S. Cl. ..... 15/167.1; 15/143.1; 15/246; 248/110; 248/188.8; 248/351; 248/688; D4/108

(58) Field of Classification Search ..... 15/143.1, 15/167.1, 246; 248/110, 188.8, 188.91, 351, 248/455, 682, 685, 686, 688, 691; 401/131; D4/108, 113
See application file for complete search history.

(56) References Cited

U.S. PATENT DOCUMENTS

| | | | | |
|---|---|---|---|---|
| 851,550 | A | 4/1907 | Nevius | |
| 1,700,876 | A * | 2/1929 | Blitz | 248/691 |
| 2,568,907 | A * | 9/1951 | Bernstein | 248/351 |
| 5,875,516 | A | 3/1999 | Blue | |
| 6,101,660 | A | 8/2000 | Mroczka | |
| 6,253,406 | B1 | 7/2001 | Holland | |
| D477,466 | S * | 7/2003 | Jones | D4/108 |
| 6,907,638 | B2 | 6/2005 | Katz | |
| 7,246,400 | B2 | 7/2007 | Ryan | |
| 2002/0073496 | A1 | 6/2002 | Kim | |

FOREIGN PATENT DOCUMENTS

| | | |
|---|---|---|
| CA | 2146297 | 10/1996 |
| GB | 189606674 | 1/1897 |

* cited by examiner

*Primary Examiner* — Mark Spisich
(74) *Attorney, Agent, or Firm* — Sand & Sebolt

(57) ABSTRACT

A toothbrush with a bristled head and a handle that includes a pivotable stand. The stand is movable between a collapsed position where an interior surface of the stand is proximate an outer wall of the handle, and an extended position where the stand extends outwardly away from the outer wall and at an angle thereto. This movement is effected by contacting a small flange or a lever on the stand that extends slightly outwardly from the handle. Preferably, the stand is U-shaped and is configured to be received in a complementary cavity in the front wall of the handle. When in the extended position, the legs of the stand together with the end of the handle may be placed in contact with a horizontal surface thereby causing the brush to be oriented in a head-down position with the bristles retained a distance above the surface so that they can drip-dry.

33 Claims, 11 Drawing Sheets

SELF-SUPPORTING MANUAL TOOTHBRUSH

BACKGROUND OF THE INVENTION

1. Technical Field

This invention generally relates to dental care. More particularly, the invention relates to a toothbrush. Specifically, the invention relates to a manual toothbrush having a stand pivotally mounted to the handle and movable between a collapsed position, where it is disposed adjacent the handle, and an extended position where it angles outwardly from the handle, and when the stand is in the extended position it can be placed on a surface to hold the head and bristles of the brush off the surface.

2. Background Information

Both power and manual toothbrush heads need to be rinsed off after each use to dislodge debris removed from the teeth during brushing. This is typically accomplished by holding the head under running tap water. While rinsing removes most of the material trapped in the bristles, it is also necessary and recommended to allow the brush to dry as this creates a less hospitable environment for most bacteria that may remain on the bristles. Previously, most bathrooms in homes were provided with a wall-mounted toothbrush fixture which was designed to retain several toothbrushes After rinsing, the handle of the brush would be inserted through an aperture in the fixture and the head would rest on a support and would air-dry.

The design of present-day toothbrushes, however, has rendered these fixtures essentially useless because of the changes in handle design and materials. These changes have resulted in larger, rubber grip handles that cannot be inserted through the apertures in the toothbrush fixtures. Additionally, many people are no longer comfortable with putting their brushes in close proximity to those of other people, even members of their own family, as it is now commonly known that infections can be easily passed from one family member's oral care products to another. People are also not comfortable resting their toothbrushes on bathroom countertops and then placing them into their mouth.

In response to this dilemma, many people resort to using a drinking glass or other similar container for holding and drying toothbrushes. Once again, however, people are not comfortable placing their toothbrush with others in such glasses. The ideal air drying technique for brushes to is to have the bristles facing downwardly so that rinse water and other foreign materials can drip off the bristles under the influence of gravity. When brushes are stood upright, the water and foreign materials tend to drip from one region of bristles to another. If the brush is laid on a surface with the bristles extending upwardly then the water and trapped materials tend to flow downwardly toward the base of the bristles, thereby creating a wet, favorable environment in which bacteria can flourish.

Traveling is also an issue as hotels do not make provision for a suitable place for resting one's toothbrush. The counter is an especially unsuitable place for resting the brush and the types of plastic cups that are provided in hotels are lightweight and will tend to fall over if a brush is placed in it.

Several patents have been directed toward addressing this issue. U.S. Pat. No. 851,550 issued to Nevius disclosed a guard that slides onto the handle of the toothbrush. The purpose of the guard, according to the patent, is twofold. Firstly, it stops the water, toothpaste and removed material from sliding down the handle and onto the user's hand. Secondly, it was designed to support the bristle portion of the brush so when the brush is laid down, the bristle portion will be aired. While the guard might accomplish the purpose of shielding the user's hand during brushing, the shape of the guard is such that if the brush were to be laid down on a counter it might roll off the same or the brush might tip in such a manner that the head is caused to rest on the counter instead of being lifted off the same. Furthermore, the guard is an obstruction on the handle and would likely make the brush sufficiently difficult to hold that the user will remove the same.

U.S. Pat. No. 5,875,516 issued to Blue, also discloses a guard that is slidingly engaged on the handle of a toothbrush to prevent slurry from sliding down the handle and onto the hands of the user. Most of the shapes of the guard would not encourage the toothbrush to roll off the counter and would act as a sufficient support so that the head of the brush may air-dry. Again, however, the guard is an obstruction on the handle. This guard is sufficiently large enough that it might also be a problem for the user during actual brushing of the teeth as the guard extends away from the brush handle to such a degree that it might strike the user's chin or cheek.

U.S. Pat. No. 6,907,638 issued to Katz, teaches a toothbrush that has a stand slidably engaged on the end of the handle. The stand includes three legs and allows the user to store the brush in an upright position on a flat surface. The stand is made from a flexible or resilient material that allows the user to hold the stand against the handle during the brushing operation so that it doesn't become an obstruction during brushing.

U.S. Pat. No. 6,253,406 issued to Holland, discloses a toothbrush that has a specially designed handle. The handle includes an inner region to which the head is attached. The inner region also includes an enlarged area that has a plurality of fluted paths formed therein. A movable ring is provided that includes several shafts that are designed to slide up and down the fluted paths. When the ring is moved in a first direction, the shafts are retracted against the handle and the brush may be used for brushing teeth. When the ring is moved in a second direction, the shafts slide outwardly beyond the head of the brush and become legs upon which the toothbrush can stand for drying. When the shafts are extended in this manner, the brush is in an inverted position with the head in close proximity to the surface upon which the legs rest. One of the problems with this design is that the fluted paths will tend to act as guides for slurry to flow down toward the user's hand. This may allow liquid and materials removed from the teeth to become trapped beneath the shafts and in the flutes. The inner surface of the shafts and the flutes may then become breeding grounds for bacteria. Consequently, when the brush is inverted and liquid flows out of the flutes and off the shafts, some of these bacteria might be entrained in the liquid and be deposited directly onto the head of the brush.

Finally, U.S. Pat. No. 7,246,400 issued to Ryan, shows an alternative method of protecting the head of a toothbrush. The patent discloses a brush that incorporates a pivotable cover. The handle includes a pocket into which the cover may be rotated so that the handle is easily grasped during brushing. When the user wishes to store the brush, the cover is pivoted out of the pocket and over the bristles. This design is also problematic from a hygenic point of view. When the cover is retained within the pocket the interior chamber of the cover faces outwardly. Consequently when the user brushes their teeth, liquid and removed materials slide down the handle onto the user's hand and at least partially into the chamber of the cover. Obviously, the user will run the brush, including the handle, under the tap to remove this mixture of toothpaste and removed materials, but this will cause water to flow into the cover. Consequently, when the cover is rotated over the bristles, water droplets trapped in the chamber of the cover will drip onto the bristles. Instead of aiding the bristles to dry, this cover is more likely to create a dark, wet environment in which bacteria will tend to multiply.

There is therefore a need in the art for an improved toothbrush that can rest on a horizontal surface in a sanitary manner to allow the bristles to dry easily and which does not include obstructions that will interfere with the user's hand during brushing.

SUMMARY OF THE INVENTION

The device of the present invention is a toothbrush with a bristled head and a handle that includes a pivotable stand. The stand is movable between a collapsed position where an interior surface of the stand is proximate an outer wall of the handle, and an extended position where the stand extends outwardly away from the outer wall and at an angle thereto. This movement is effected by contacting a small flange or a lever on the stand that extends slightly outwardly from the handle. Preferably, the stand is U-shaped and is configured to be received in a complementary cavity in the front wall of the handle. When in the extended position, the legs of the stand together with the end of the handle may be placed in contact with a horizontal surface thereby causing the brush to be oriented in a head-down position with the bristles retained a distance above the surface so that they can drip-dry. The stand is positioned on the handle so that when the brush is later used, no portion of the stand will enter the user's mouth.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Referring to FIGS. 1-9, there is shown a toothbrush in accordance with the present invention and generally indicated at 20. Toothbrush 20 includes a handle 22 and a head 24 and has a longitudinal axis "Y" that extends between head 24 and end 25. A plurality of bristles 26 extend outwardly from head 24 and at right angles to axis Y.

Figure 1:
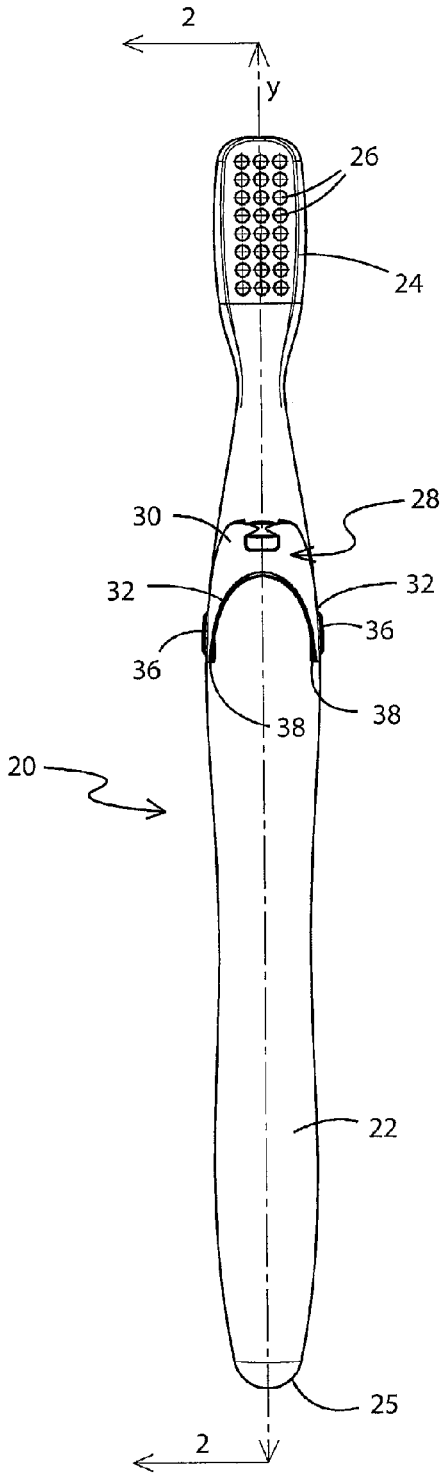
FIG. 1 is a front elevational view of a manual toothbrush that incorporates a stand in accordance with the present invention, the stand being shown in a collapsed position.
Figure 2:
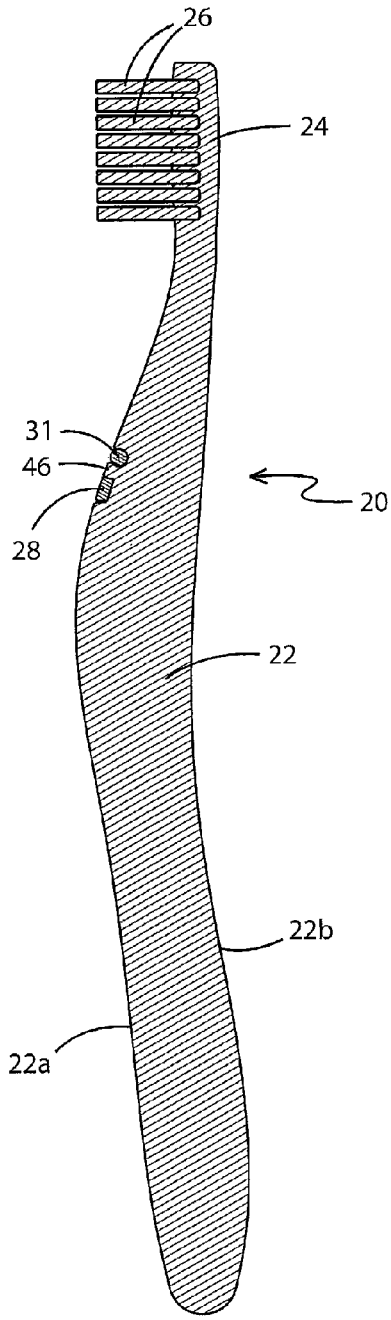
FIG. 2 is a side elevational view of the toothbrush taken through line 2-2 of FIG. 1.
Figure 3:
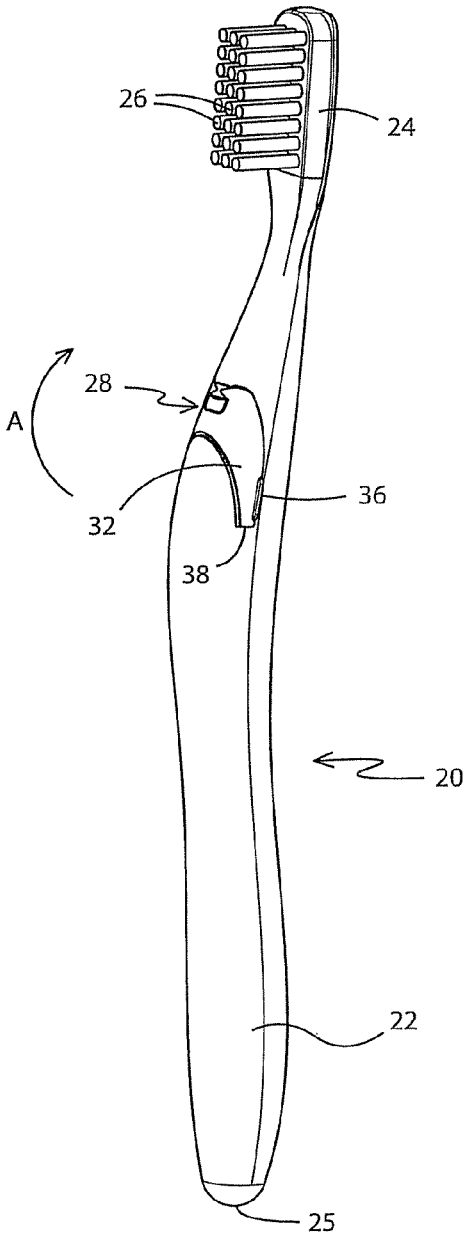
FIG. 3 is a perspective view of the toothbrush with the stand in the collapsed position.
Figure 4:
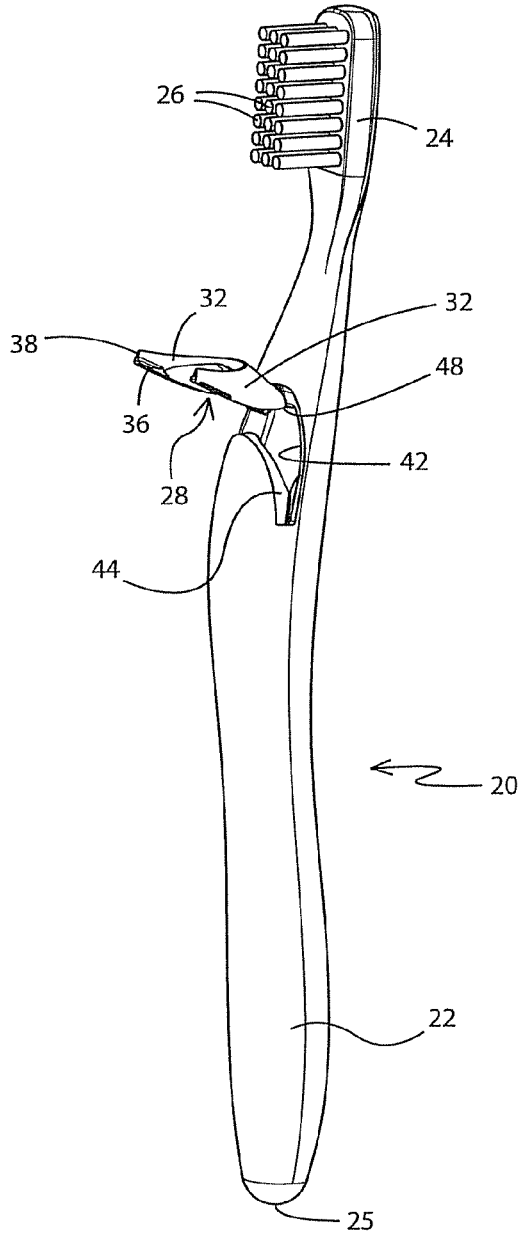
FIG. 4 is a perspective view of the toothbrush with the stand in the extended position.
Figure 5:
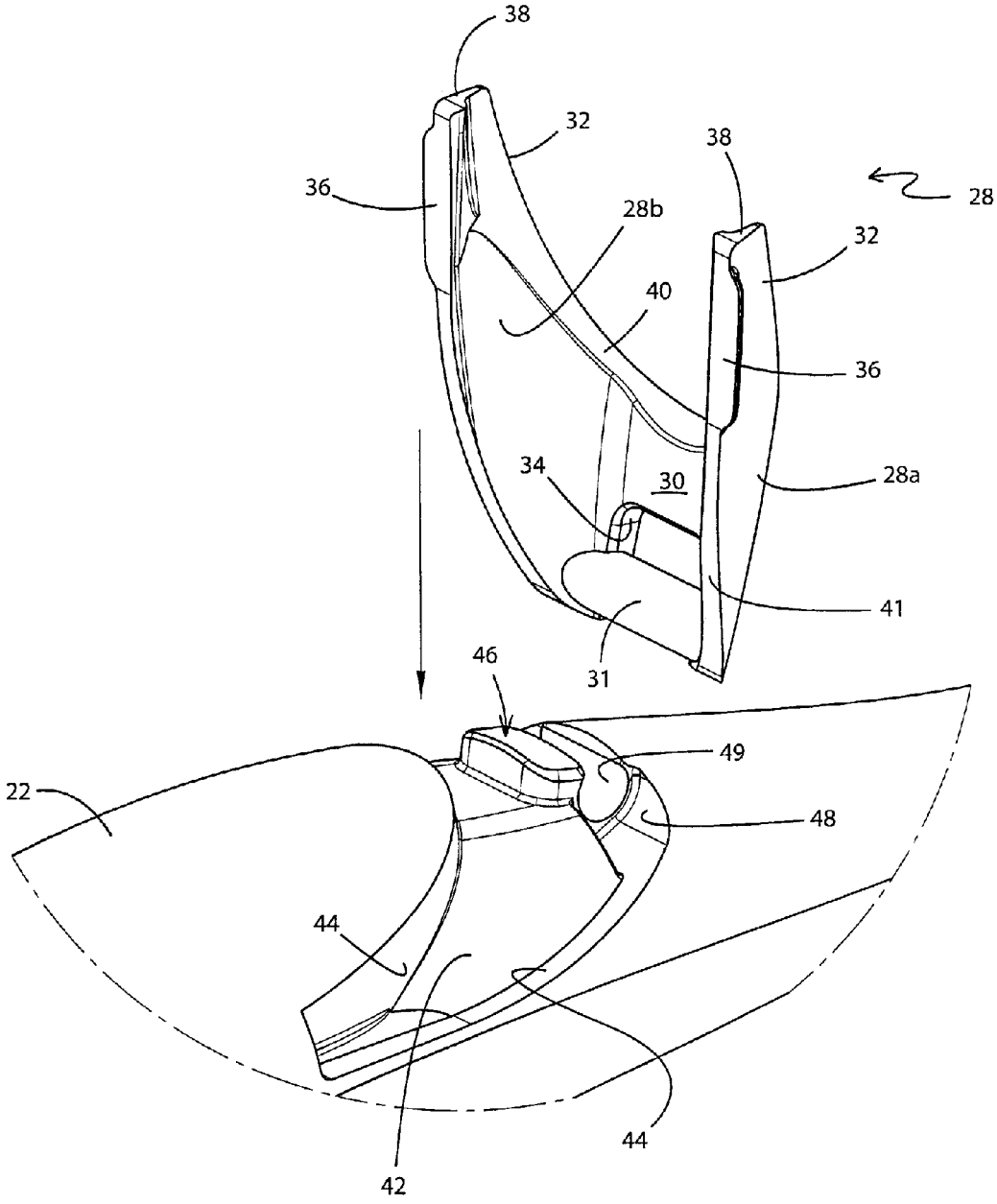
FIG. 5 is an enlarged exploded view of the stand detached from the toothbrush.
Figure 6A:
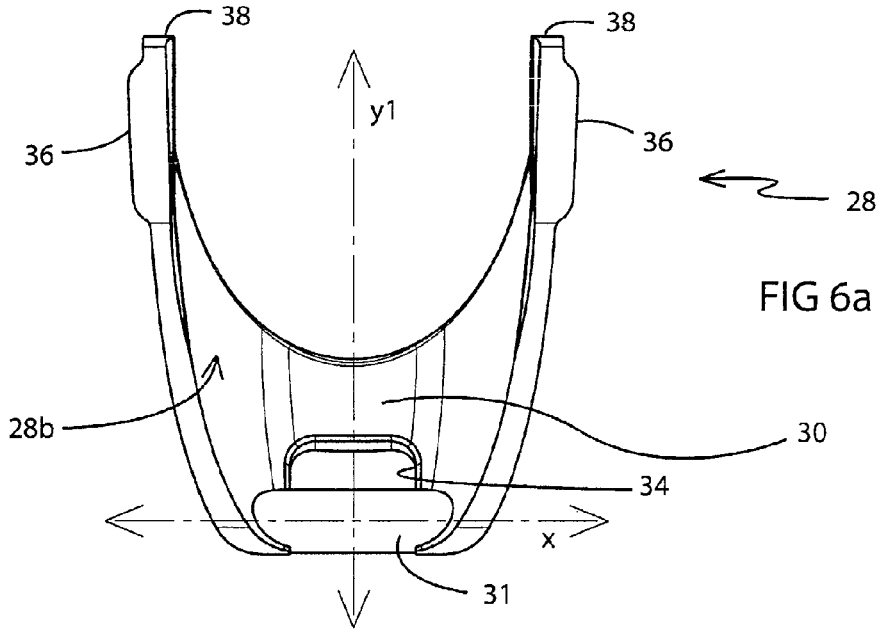
FIG. 6*a* is a rear view of the stand.
Figure 6B:
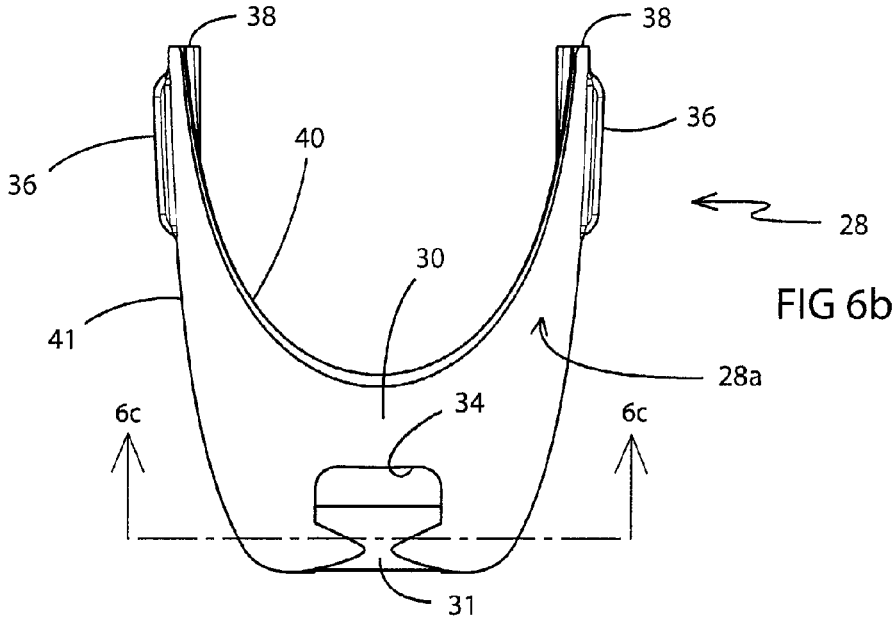
FIG. 6*b* is a front view of the stand.
Figure 6C:
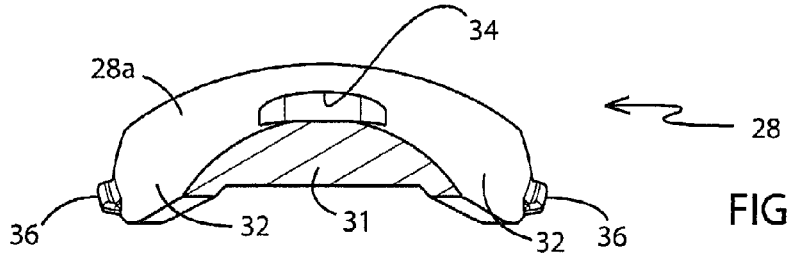
FIG. 6*c* is an end view of the stand taken through line 6*c*-6*c* of FIG. 6*b*.
Figure 7:
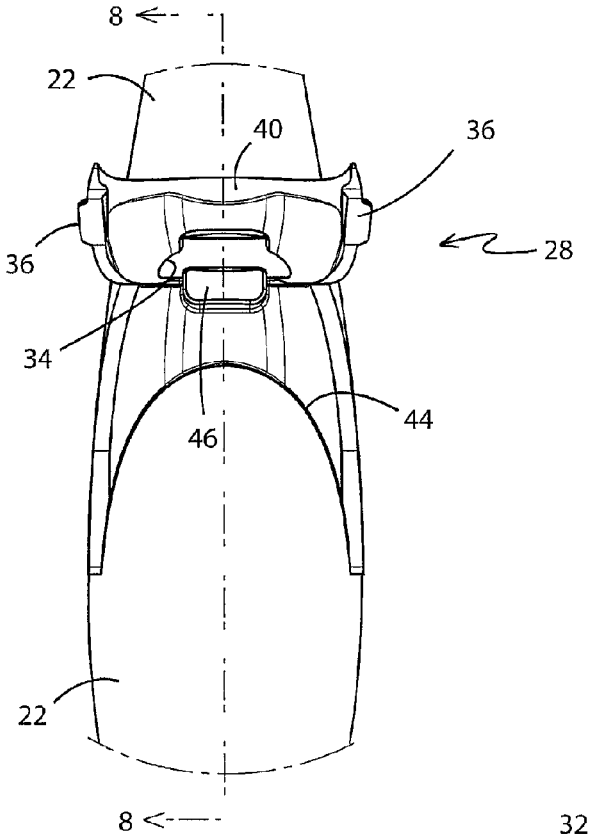
FIG. 7 is a partial front view of the toothbrush with the stand in the extended position.
Figure 8:
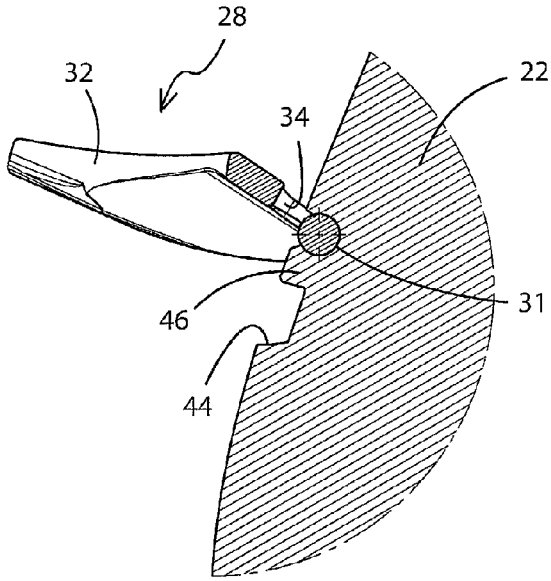
FIG. 8 is a partial cross-sectional side view of the toothbrush taken through line 8-8 of FIG. 7.
Figure 9:
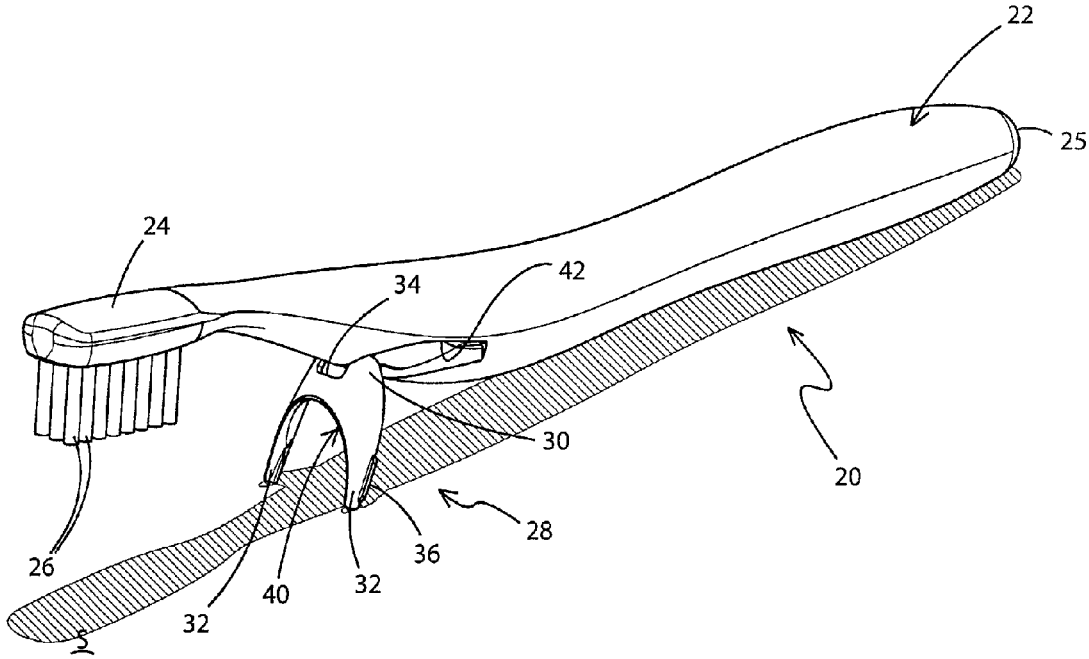
FIG. 9 is a perspective view of the toothbrush shown with the stand resting on a surface and supporting the head a distance away therefrom.
Figure 10:
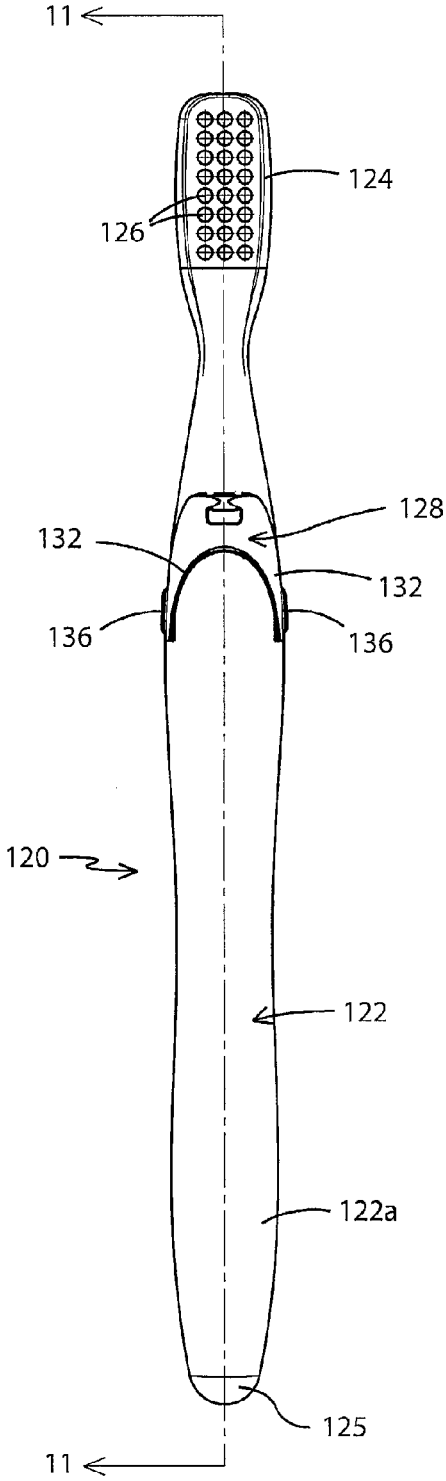
FIG. 10 is a front elevational view of a toothbrush incorporating a second embodiment of the stand in accordance with the present invention and showing the stand in the collapsed position.

In accordance with a specific feature of the present invention, toothbrush 20 is provided with a stand 28 that is movable between a collapsed position (FIG. 1) and an extended position (FIG. 4). As shown in FIGS. 5-6*c*, stand 28 is a generally U-shaped member that includes a central region 30 with a pair of legs 32 extending outwardly away therefrom. Stand 28 has a longitudinal axis Y' that is aligned with the longitudinal axis Y of toothbrush 20 when stand 28 is secured thereto. At a first end, central region 30 includes a generally cylindrical rod 31 that is disposed along a horizontal axis X and at right angles to the longitudinal axis Y' of stand 28. Central region 30 further defines an aperture 34 immediately adjacent said rod 31. Legs 32 originate proximate the ends of rod 31 and extend outwardly away therefrom and substantially aligned with longitudinal axis Y' and terminate in terminal ends 38. Stand 28 further includes an inner peripheral edge 40 and an outer peripheral edge 41, both of which are substantially U-shaped. Furthermore, both of inner and outer peripheral edges 40, 41 preferably are at least partially beveled (FIG. 5). Outer surface 28*a* of stand 28 is complementary in cross-sectional shape to the contour of handle 22. Consequently, when stand 28 is in a collapsed position, handle 22 presents a substantially continuous and smooth front surface 22 profile that is substantially free of projections which might interfere with the user holding the handle. Interior surface 28*b* preferably is similarly contoured to outer surface 28*a*. When stand 28 is in the extended position any liquid on the handle and stand is channeled downwardly toward terminal ends 38 of legs 32.

In accordance with another feature of the present invention, legs 32 are each provided with a longitudinally aligned flange 36 along outer peripheral edge 41 and proximate terminal ends 38. When stand 28 is in a collapsed position, flanges 36 extends slightly outwardly away from the exterior surface of handle 22. If the user slides a finger or thumb along the exterior surface of handle 22, they can feel flanges 36 and consequently easily locate stand 28 without needing to look at the same. Flanges 36 can be used to move stand 28 between the collapsed and extended positions as will be hereinafter described.

Handle 22 defines a substantially U-shaped recess 42 (FIG. 4) therein that is complementary in shape and size to stand 28. When stand 28 is collapsed into recess 42, the outer profile of handle 22 is essentially smooth and uninterrupted (see FIG. 2). Furthermore, as shown in FIG. 5, the surface 44 of the wall of handle 22 which surrounds and defines recess 42 is complementary shaped to mate with inner and outer peripheral edges 40, 41 of stand 28. A projection 46 (FIG. 5) extends inwardly into recess 42 from the upper wall 48 of handle 22. Projection 46 is shaped and sized to be received through aperture 34 in stand 28 when stand 28 is in the collapsed position. Projection 46 blocks aperture 34 and prevents liquid and particulate material removed from the teeth from entering cavity 42 in handle 22.

A groove 49 is formed in upper wall 48 of handle 22 and adjacent to projection 46. Groove 49 is substantially complementary in cross-sectional shape and size to rod 31. Groove 49 is aligned at right angles to the longitudinal axis Y of toothbrush 20. When stand 28 is engaged with toothbrush handle 22, rod 31 is snap-fitted into groove 49 and is tightly retained within groove 49. When stand 28 is moved between the collapsed and extended positions, rod 31 rotates within groove 49 and about the horizontal axis X of stand 28.

Toothbrush 20 is used in the following manner. When the user has finished brushing their teeth, they grasp handle 22 in their hand and, using their thumb, engage one of flanges 36 on stand 28, pushing stand 28 outwardly away from handle 22. This causes rod 31 on stand 28 to pivot within groove 49, moving stand 28 in the direction indicated by arrow "A" in FIG. 3. When in a fully extended position, stand 28 preferably locks into place and extends outwardly from outer wall 22*a* of handle 22 at an angle of between approximately 90 degrees and 120 degrees relative to handle 22. The stand 28 substantially locks in place to prevent the user from only partially extending the stand and then having it later accidentally collapse, thereby bringing bristles 26 into contact with a contaminated surface. Once stand 28 is in the fully extended position the user may rest toothbrush 20 (FIG. 9) on surface S by placing ends 38 of legs 32 and end 25 of handle 22 on surface S. This retains toothbrush 20 at an angle to surface S with end 25 of handle 22 in abutting contact with the surface and the head 24 and bristles 26 spaced a distance above surface S. Consequently, any liquid and materials entrained therein will tend to drip off bristles 26 and onto surface S.

When the user next wishes to brush their teeth, they grasp the handle 22 and using a finger or thumb push stand 28 back toward handle 22. This causes rod 31 on stand 28 to pivot in groove 49 in the opposite direction to arrow "A" (FIG. 3) and to once again become seated in recess 42. Preferably, the exterior contour of stand 28 and the shape of the peripheral inner and outer surfaces 40, 41 and the mating surfaces 44, 48 of recess 42 are shaped so that, during brushing, liquid is encouraged to flow outwardly onto handle 22 and not into recess 42. Once the user has finished brushing their teeth, the toothbrush 20, including bristles 26, head 24, handle 22 and recess 42 can be rinsed off. The user then uses his or her thumb to engage one of flanges 36 and pivot stand 28 into the extended position as previously described.

Figure 11:
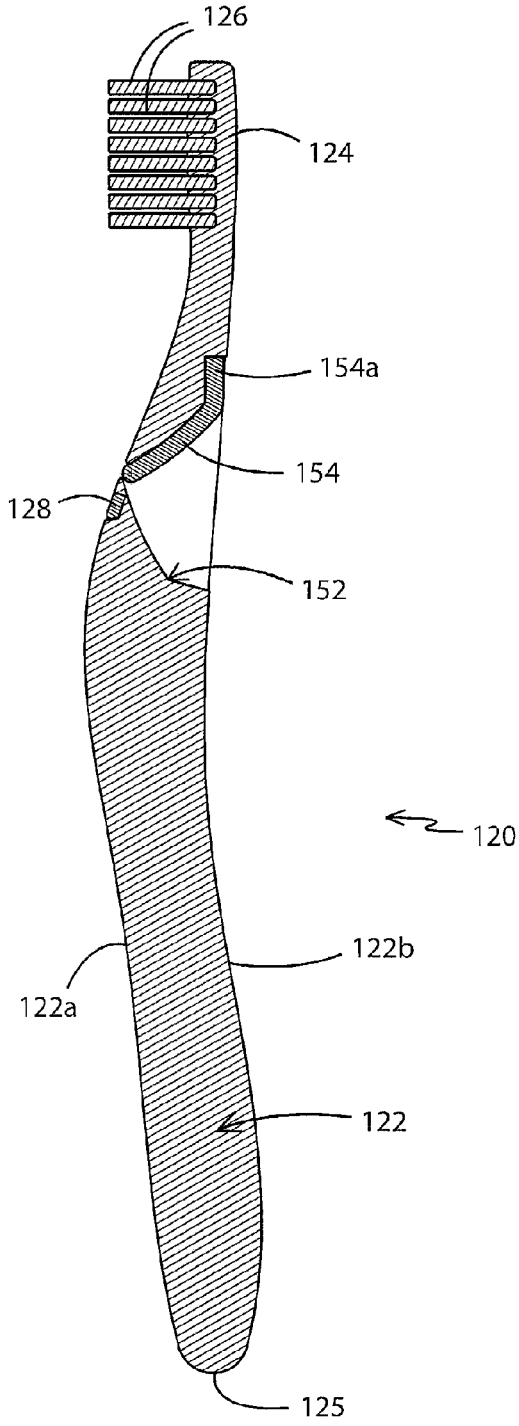
FIG. 11 is a cross-sectional side view of the toothbrush taken through line 11-11 of FIG. 10.
Figure 12:
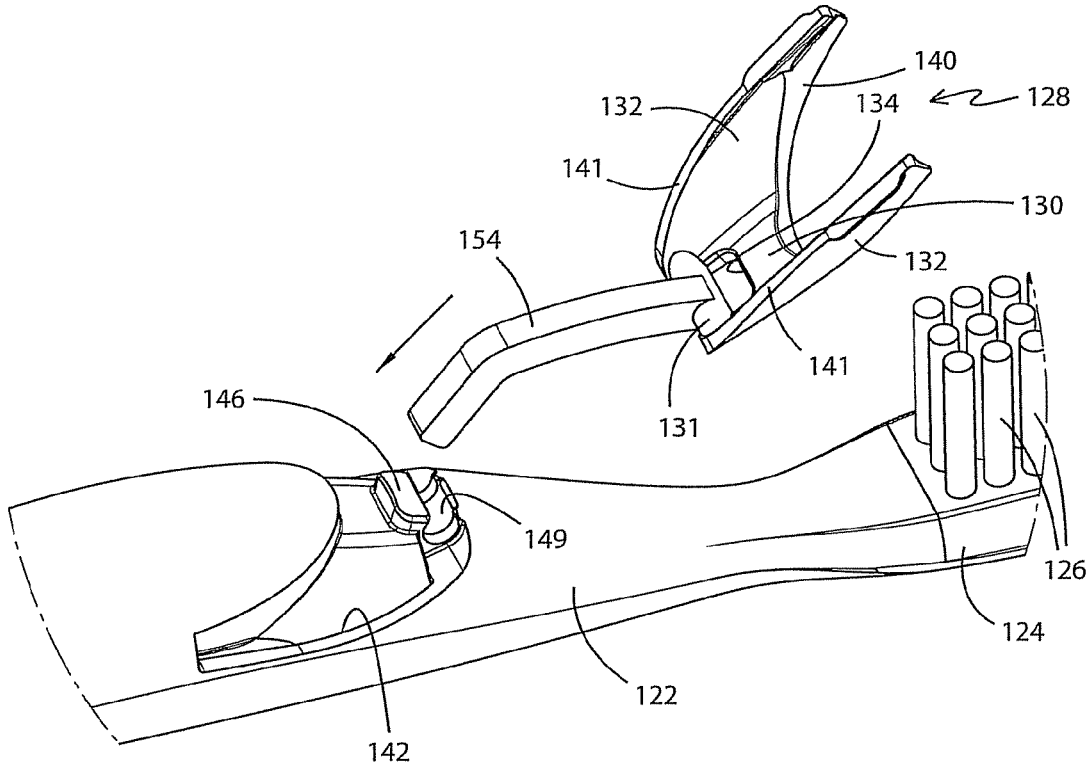
FIG. 12 is an exploded partial perspective view of the toothbrush with the stand detached therefrom.
Figure 13:
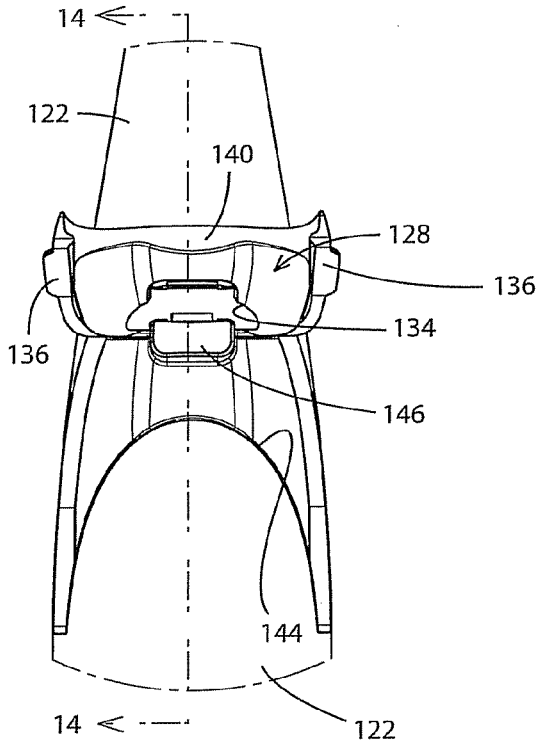
FIG. 13 is a partial front view of the toothbrush with the stand in the extended position.

FIGS. 10-17 show a toothbrush 120 that incorporates a second embodiment of a stand in accordance with the present invention. The second embodiment of the stand is generally indicated at 128. Toothbrush 120 includes a handle 122 and a head 124 with bristles 126 extending outwardly therefrom and a longitudinal axis Y extending between end 125 and head 124. Handle 122 has a front wall 122*a* and a rear wall 122*b*. Handle 122 defines a recess 142 in front wall 122*a* and a slot 150 in rear wall 122*b*. As shown in FIG. 11, recess 142 and slot 150 constitute openings into an interior chamber 152 within handle 122.

Stand 128 comprises a generally U-shaped member having a central region 130 with two legs 132 extending outwardly away therefrom. As with the previous embodiment, stand 128 is complementary in cross-sectional shape to the contour of handle 122 so that when the stand is in a collapsed position, handle 122 presents a substantially continuous and smooth profile that is substantially free of projections that might interfere with the user holding the handle. Stand 128 further includes a rod 131 that is shaped to be interlockingly received in a groove 149 in handle 122. Central region 130 defines an aperture 134 adjacent rod 131. Legs 132 are each provided with a flange 136 along the outer peripheral edge 141 and these flanges 136 are substantially aligned with the longitudinal axis of stand 128.

Figure 14:
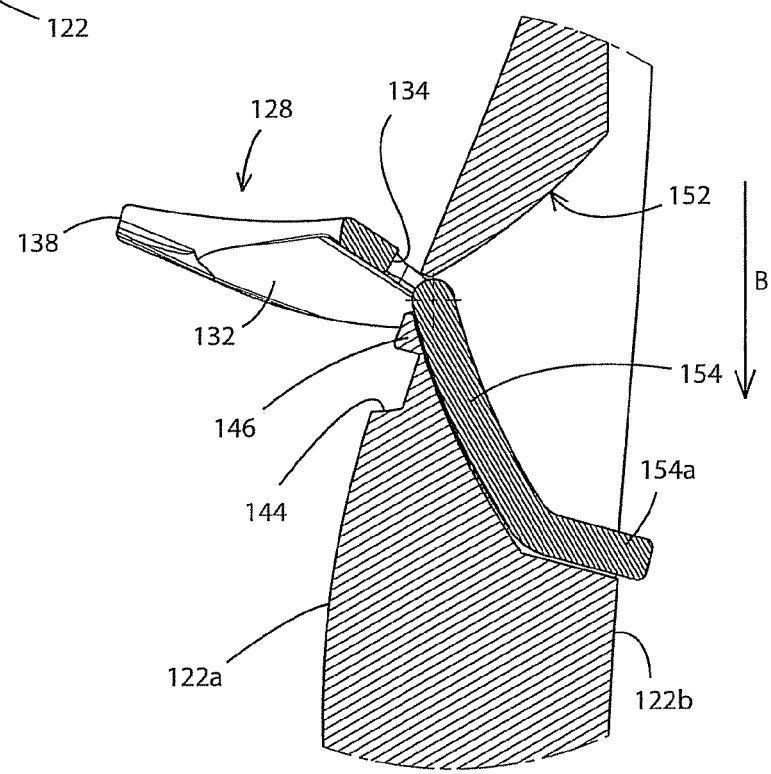
FIG. 14 is a partial cross-sectional side view of the toothbrush taken through line 14-14 of FIG. 13.
Figure 15:
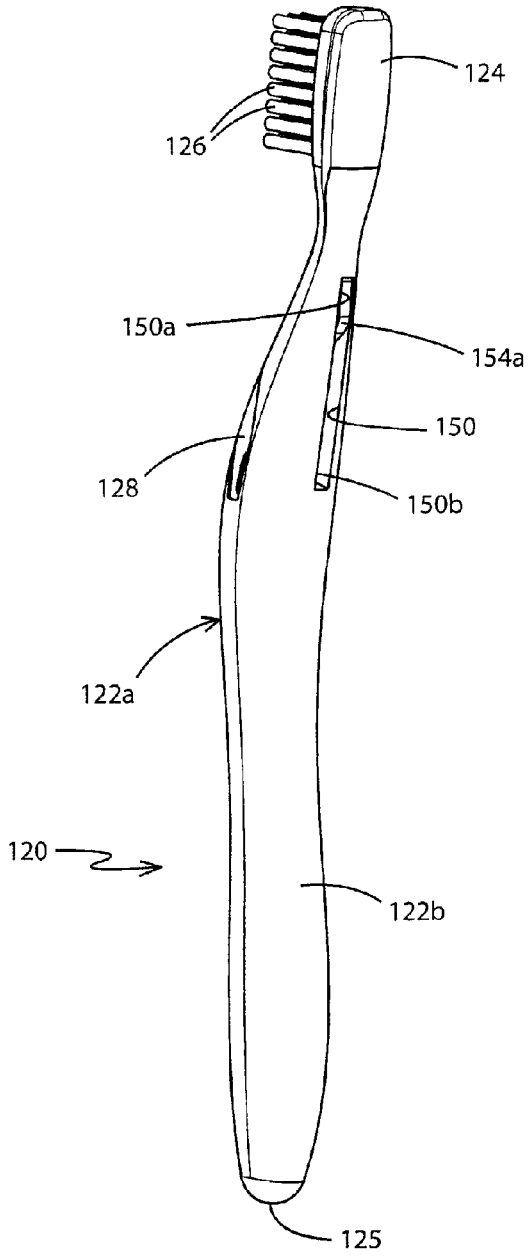
FIG. 15 is a perspective rear view of the toothbrush showing the position of the lever when the stand is in the collapsed position.
Figure 16:
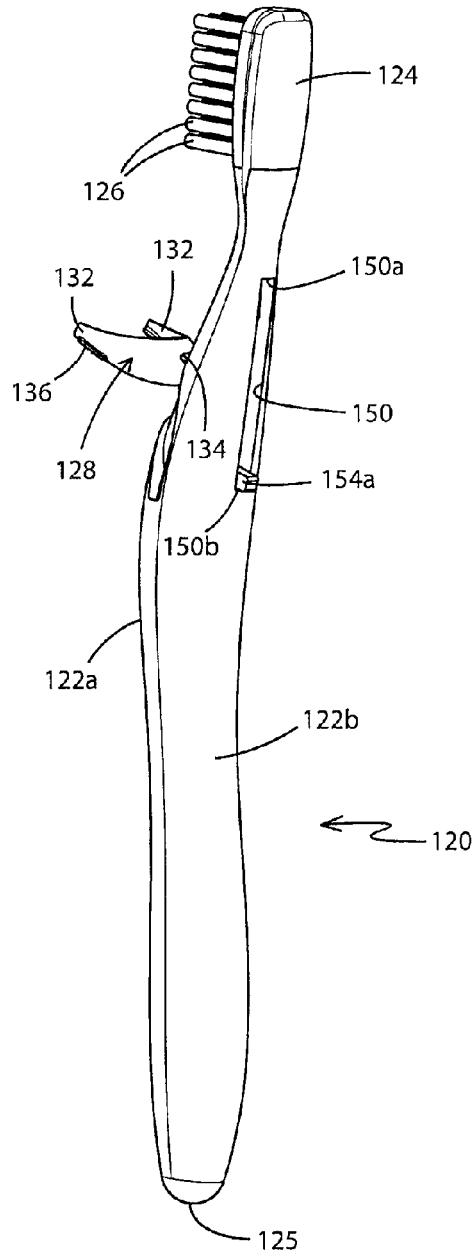
FIG. 16 is a perspective rear view of the toothbrush showing the position of the lever when the stand is in the extended position.
Figure 17:
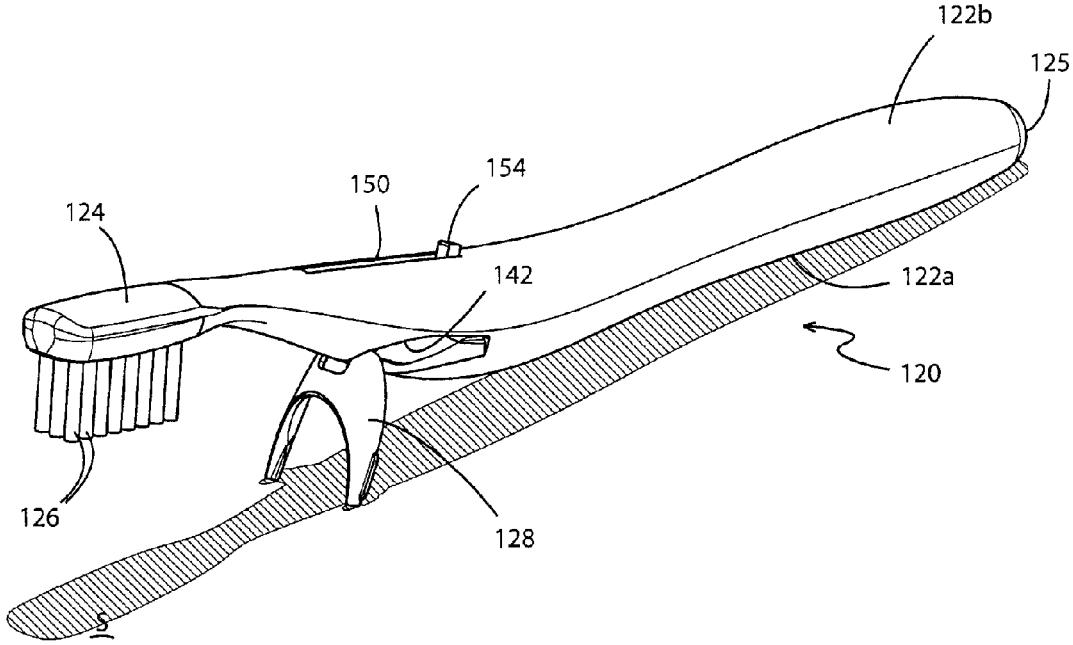
FIG. 17 is a perspective view of the toothbrush with the stand in an extended position and engaging the surface.

In accordance with a specific feature of the second embodiment, stand 128 further includes a longitudinally aligned lever 154 that extends outwardly away from rod 131 and in the opposite direction to legs 132. When stand 128 is secured to handle 122, lever 154 is introduced into recess 142 and into cavity 152. Proximate rear wall 122*b* of handle 122, cavity narrows to forms slot 150. Lever 154 is sized so that at least the terminal end 154*a* thereof is received in slot 150. When stand 128 is in the collapsed position (FIGS. 10, 11 & 15), legs 132 of stand 128 extend downwardly toward bottom end 125 of handle 122 and terminal end 154*a* of lever 154 extends upwardly toward head 124 of brush 120. Terminal end 154*a* abuts end 150*a* of slot 150. When stand 128 is in this collapsed position, terminal end 154*a* preferably does not extend outwardly from rear wall 122*b* of brush 120 as is shown in FIG. 11. When stand 128 is in the extended position (FIGS. 13, 14, 16), legs 132 of stand 128 extend outwardly away from handle 122 and approximately at right angles thereto. Terminal end 154*a* of lever 154 is disposed proximate lower end 150*b* of slot 150 (FIG. 16). As shown in FIG. 14, when stand 128 is in this extended position, at least a portion of terminal end 154*a* of lever 154 extends outwardly beyond rear wall 122*b* of handle 122.

Stand 128 may be moved between the collapsed and extended positions by contacting flange 136 on one of legs 132 with a finger or thumb and pivoting stand 128 by moving their finger or thumb outwardly away or inwardly toward handle 122, as previously described. An alternative method for moving stand 128 from the extended position to the collapsed position is by sweeping a finger or thumb along rear wall 122*b* of brush 122 in the direction indicated by arrow "B" (FIG. 14). The finger or thumb will catch the end 154*a* of lever 154 and move the same in the direction "B". This will cause rod 131 of stand 128 to rotate within groove 149 thereby causing stand 128 to pivot from the extended position back into the collapsed position. It will be understood that lever 154 can be formed so that at least a portion of terminal end 154*a* extends outwardly from top end 150*a* of slot 150. In this instance, stand 128 could be rotated from the collapsed position into the extended position by sweeping a finger or thumb downwardly along rear wall 122*b* in the opposite direction to arrow B.

When stand 128 is in the extended position, toothbrush 120 can be rested on surface S by placing ends 138 of stand 128 and end 125 of brush onto surface S. As with the first embodiment, toothbrush 120 thereby is angled on surface S in a manner that head 124 and bristles 126 are kept a distance above the surface so that they may drip-dry.

It will be understood that while stand 28 is shown as having two terminal ends 38, stand 28 may alternatively be shaped so that only one terminal end will contact surface S when stand 28 is in the extended position.

It will be understood that while the stand 28 is shown pivotally mounted to the front wall 22*a* of handle 22, the stand may, alternatively, be mounted to a side wall or to rear wall 22*b* in such a location that when stand 28 is in the extended position, terminal ends 38 thereof contact surface S and retain head 24 and bristles 26 a spaced distance away therefrom.

Obviously, if stand 28 is mounted to a side wall, head 24 and bristles 26 will be oriented sideways. If stand 28 is mounted on rear wall 22*b*, bristles 26 would extend upwardly away from surface S.

It will further be understood that while stand 28 is shown as mounted so it is flush or aligned with the front surface wall 22*a* of handle 22, stand 28 may, alternatively, be mounted so that interior surface 28*b* thereof abuts front wall 22*a* of handle 22.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A toothbrush comprising:

a handle having an outer wall;

a head extending from the handle;

a plurality of bristles extending outwardly from the head; and a substantially U-shaped stand comprising a central region with a first leg and a second leg extending outwardly therefrom, wherein the central region is pivotally secured to the outer wall of the handle; wherein the stand is movable between a collapsed position where a portion of the stand is substantially flush with the outer wall, and an extended position where the stand extends outwardly away from the outer wall and at an angle thereto; and wherein the stand includes at least one surface-engaging end on one of the first and second legs that is adapted to contact a remote surface when the stand is in the extended position and to thereby retain the head and bristles a spaced distance away from the remote surface.

2. The toothbrush as defined in claim 1, wherein the stand has a longitudinal axis extending between the central region and the at least one surface-engaging end, and when the stand is moved between the collapsed and extended positions it rotates about an axis disposed at right angles to the longitudinal axis.

3. The toothbrush as defined in claim 2, wherein the outer wall of the handle defines a cavity therein and the stand and cavity are complementary; and when the stand is in the collapsed position the stand is substantially received in said cavity and an outer surface of the stand is substantially coplanar with the outer wall of the handle.

4. The toothbrush as defined in claim 3, wherein the stand further includes a flange that extends outwardly away from the outer surface thereof a spaced distance away from the central region; wherein the flange projects outwardly from the outer wall of the handle when the stand is in the collapsed position; and wherein the flange is adapted to be engaged by a user to move the stand from the collapsed position to the extended position.

5. The toothbrush as defined in claim 4, wherein the flange is oriented substantially parallel to the longitudinal axis of the stand.

6. The toothbrush as defined in claim 3, wherein the outer wall of the handle further defines a slot in a position opposed to said cavity; and wherein said cavity and slot are in communication with each other.

7. The toothbrush as defined in claim 6, wherein the stand further includes a lever that extends outwardly away from proximate the central region thereof and in a direction opposite to the surface engaging end, and wherein said lever extends through the cavity and at least partially into the slot.

8. The toothbrush as defined in claim 7, wherein the lever has a terminal end that is complementary shaped to be received in the slot and said terminal end moves between an upper end and lower end of the slot when the stand is rotated between the collapsed and extended positions.

9. The toothbrush as defined in claim 8, wherein the terminal end of the lever is disposed proximate the upper end of the slot when stand is in the collapsed position and proximate the lower end of the slot when the stand is in the extended position.

10. The toothbrush as defined in claim 9, wherein the terminal end of the lever extends beyond the outer wall of the handle when the stand is in at least one of the collapsed and extended positions, and when so extended, the terminal end of the lever is adapted to be moved toward one of the upper and lower ends of the slot to pivot the stand.

11. The toothbrush as defined in claim 10, wherein the handle cavity is substantially U-shaped into which the U-shaped member is fittingly received when the stand is in the collapsed position.

12. The toothbrush as defined in claim 11, further comprising at least one flange extending outwardly away from an exterior surface of one of the legs of the stand; said flange being adapted to be engaged to move the stand between the collapsed and extended positions.

13. The toothbrush as defined in claim 12, wherein the toothbrush has a longitudinal axis extending between the head of the brush and an end of the handle; and wherein the legs of the stand extend substantially parallel to the longitudinal axis of the toothbrush when the stand is in the collapsed position, and the flange projects outwardly away from the outer wall of the handle.

14. The toothbrush as defined in claim 11, wherein the stand is pivotally mounted to a front wall of the handle and the slot is defined in a rear wall of the handle, and the surface-engaging end of the stand comprises one end of one of the legs and a second surface-engaging end is one end of the other leg; and when the stand is in the extended position, the ends of the legs and an end of the handle are adapted to engage a remote surface and keep the brush in a bristle-down orientation with the bristles spaced a distanced from the surface.

15. The toothbrush as defined in claim 14, wherein the toothbrush has a longitudinal axis extending between the head of the brush and the end of the handle, and the longitudinal axis of the stand is substantially aligned with the longitudinal axis of the toothbrush and the stand pivots between the extended and collapsed positions about an axis disposed at right angles to the longitudinal axes of the brush and stand.

16. The toothbrush as defined in claim 1, wherein the surface-engaging end of the stand comprises a terminal end of one of the first and second legs; and wherein a terminal end of the other of the first and second legs comprises a second surface-engaging end; and when the stand is in the extended position the terminal ends of the legs are adapted to engage the remote surface and keep the head and bristles a spaced distance therefrom.

17. The toothbrush as defined in claim 16, wherein the stand has a longitudinal axis extending from the central region and intermediate the first and second legs; and wherein the central region of the stand includes a rod disposed at right angles to the longitudinal axis, and the rod is pivotally engaged with the handle.

18. The toothbrush as defined in claim 17, wherein the outer wall of the handle defines a groove complementary to the rod on the stand; and the rod is frictionally engaged in the groove, and when the stand is moved between the collapsed and extended positions, the rod rotates within the groove.

19. The toothbrush as defined in claim 1, wherein the central region of the U-shaped stand is pivotally secured to a front region of the outer wall of the handle, and when the stand is in the collapsed position an outer surface of the central region is substantially flush with an outer surface of the outer wall of the handle, and the first leg of the stand is disposed adjacent a left side of the outer wall and the second leg of the stand is disposed adjacent a right side of the outer wall.

20. The toothbrush as defined in claim 19, wherein the outer wall of the handle defines a cavity therein and the stand is receivable within the cavity when in the collapsed position, and wherein the cavity includes a first region, a second region and a third region, and the first region is defined in the front region of the outer wall and is complementary to the central region of the stand, the second region is defined in the left side of the outer wall and is complementary to the first leg, and the third region is defined in the right side of the outer wall and is complementary to the second leg.

21. The toothbrush as defined in claim 20, wherein the stand further includes a first flange that extends outwardly from one of the first and the second legs, and the first flange extends outwardly for a distance from the one of the left side and the right side of the outer wall.

22. The toothbrush as defined in claim 21, further comprising a second flange that extends outwardly from the other of the first and the second legs, and the second flange extends outwardly for a distance from the other of the left side and the right side of the outer wall.

23. The toothbrush as defined in claim 22, wherein the first and second flanges extend outwardly from the outer wall in opposite directions from each other.

24. The toothbrush as defined in claim 21, wherein the first flange is disposed adjacent the terminal end of the one of the first and the second legs.

25. A toothbrush comprising:

a handle having an outer wall;

a head extending from the handle:

a plurality of bristles extending outwardly from the head; and a stand pivotally secured to the handle and being movable between a collapsed position where an interior surface of the stand is proximate the outer wall of the handle and an extended position where the stand extends outwardly away from the outer wall and at an angle thereto; and wherein the stand comprises:

a substantially U-shaped member having a first end with first and second legs extending outwardly away therefrom and having a longitudinal axis extending from the first end and intermediate the first and second legs; and wherein the said first end of the stand is pivotally secured to the handle and includes:

a rod disposed at right angles to the longitudinal axis, where the rod is pivotally engaged with the handle;

a first surface-engaging end comprising a terminal end of one of the first and second legs;

a second surface-engaging end comprising a terminal end of the other of the first and second legs; and when the stand is in the extended position, the terminal ends of the first and second legs are adapted to contact a remote surface and to thereby retain the head and bristles a spaced distance away from the remote surface; and wherein the outer wall of the handle defines a groove complementary to the rod on the stand; and the rod is frictionally engaged in the groove and when the stand is moved between the collapsed and extended positions, the rod rotates within the groove; and wherein the stand defines an aperture positioned adjacent to said rod, and the handle further includes a projection that extends outwardly away from the outer wall thereof, said projection being positioned proximate the groove, and wherein the projection is complementary in shape and size to the aperture and is received therein when the stand is in the collapsed position.

26. The toothbrush as defined in claim 25, wherein the stand rotates about an axis disposed at right angles to the longitudinal axis when the stand is moved between the collapsed and extended positions.

27. The toothbrush as defined in claim 26, wherein the outer wall of the handle defines a cavity therein and the stand and cavity are complementary; and when the stand is in the collapsed position the stand is substantially received in said cavity and an outer surface of the stand is substantially coplanar with the outer wall of the handle.

28. The toothbrush as defined in claim 25, wherein the stand further includes a flange that extends outwardly away from an outer surface thereof and projects outwardly from the outer wall of the handle when the stand is in the collapsed position.

29. The toothbrush as defined in claim 28, wherein the flange is oriented substantially parallel to the longitudinal axis of the stand.

30. A toothbrush comprising:

a handle having an outer wall;

a head extending from the handle;

a plurality of bristles extending outwardly from the head; and a stand pivotally secured to the handle and being movable between a collapsed position where an interior surface of the stand is proximate the outer wall of the handle and an extended position where the stand extends outwardly away from the outer wall and at an angle thereto; and wherein the stand comprises:

a substantially U-shaped member having a first end with first and second legs extending outwardly away therefrom and having a longitudinal axis extending from the first end and intermediate the first and second legs; and wherein the said first end of the stand is pivotally secured to the handle and includes:

a rod disposed at right angles to the longitudinal axis, where the rod is pivotally engaged with the handle;

a first surface-engaging end comprising a terminal end of one of the first and second legs;

a second surface-engaging end comprising a terminal end of the other of the first and second legs; and when the stand is in the extended position, the terminal ends of the first and second legs are adapted to contact a remote surface and to thereby retain the head and bristles a spaced distance away from the remote surface; and wherein the outer wall of the handle defines a groove complementary to the rod on the stand; and the rod is frictionally engaged in the groove and when the stand is moved between the collapsed and extended positions, the rod rotates within the groove; and wherein the outer wall of the handle defines a substantially U-shaped cavity that is complementary to the U-shaped member; and when the stand is in the collapsed position the stand is received into the cavity and an outer surface of the stand is substantially coplanar with the outer wall of the handle, whereby the handle has a substantially continuous appearance.

31. The toothbrush as defined in claim 30, wherein the stand rotates about an axis disposed at right angles to the longitudinal axis when the stand is moved between the collapsed and extended positions.

32. The toothbrush as defined in claim 30, wherein the stand further includes a flange that extends outwardly away from an outer surface thereof and projects outwardly from the outer wall of the handle when the stand is in the collapsed position.

33. The toothbrush as defined in claim 32, wherein the flange is oriented substantially parallel to the longitudinal axis of the stand.

* * * * *